US006320110B1

(12) United States Patent
Ishikawa et al.

(10) Patent No.: US 6,320,110 B1
(45) Date of Patent: Nov. 20, 2001

(54) MUSIC GAME DEVICE WITH AUTOMATIC SETTING, METHOD FOR CONTROLLING THE SAME, AND STORAGE MEDIUM THEREFOR

(75) Inventors: Hirotaka Ishikawa; Akinori Tamura; Yasumi Takase; Takashi Nishibori; Kei Nagaoka; Yoshiko Wada; Yumi Yoshida; Kazuya Takahashi, all of Tokyo (JP)

(73) Assignees: Konami Corporation; KCE Tokyo Inc., both of Tokyo (JP)

( * ) Notice: Subject to any disclaimer, the term of this patent is extended or adjusted under 35 U.S.C. 154(b) by 0 days.

(21) Appl. No.: 09/638,813

(22) Filed: Aug. 14, 2000

(30) Foreign Application Priority Data

Aug. 25, 1999 (JP) ..... 11-239021

(51) Int. Cl.[7] ..... G10H 1/26

(52) U.S. Cl. ..... 84/600; 84/609; 84/644; 434/307 A

(58) Field of Search ..... 84/600, 609–614, 84/634–638, 644; 434/307 A

(56) References Cited

U.S. PATENT DOCUMENTS

| | | | | |
|---|---|---|---|---|
| 5,095,798 | * | 3/1992 | Okada et al. | 84/609 |
| 5,399,799 | * | 3/1995 | Gabriel | 84/609 |
| 5,405,053 | | 4/1995 | Zublin . | |
| 5,613,909 | | 3/1997 | Stelovsky . | |
| 5,739,457 | | 4/1998 | Devecka . | |
| 5,763,804 | * | 6/1998 | Rigopulos et al. | 84/635 |
| 5,824,933 | * | 10/1998 | Gabriel | 84/609 |
| 5,864,868 | * | 1/1999 | Contois | 84/609 X |
| 5,973,250 | * | 10/1999 | Zirille et al. | 84/600 |
| 6,031,174 | * | 2/2000 | Takabayashi | 84/609 |

FOREIGN PATENT DOCUMENTS

| | | |
|---|---|---|
| 0702366 | 3/1996 | (EP) . |
| 06-308985 | 11/1994 | (JP) . |
| 07-085638 | 3/1995 | (JP) . |
| 08/212760 | 8/1996 | (JP) . |

* cited by examiner

*Primary Examiner*—Stanley J. Witkowski
(74) *Attorney, Agent, or Firm*—Jordan and Hamburg LLP

(57) ABSTRACT

A music game device is provided in which a player manipulates a manipulation unit in conformity with music. The device includes an input unit for setting play information including a plurality of tunes to be successively played and a play order of the plurality of tunes, a storage unit for collectively storing the play information, an automatic setting changing unit for automatically changing a part of the play information set by the player to a preset standard play information if the play information set by the player includes a setting which cannot be executed by the music game device, and a reproduction unit for successively reproducing the plurality of tunes in the play order based on the play information stored in the storage unit.

17 Claims, 10 Drawing Sheets

FIG. 10A

NON STOP ORDER

2ndReMIX [1] [2] [3]
3rdMIX [1] [2] [3]
EXIT

NOW CHECKING EDIT DATA AVAILABLE.
DO NOT REMOVE MEMORY CARD !

FIG. 10B

NON STOP ORDER

2ndReMIX [1] [2] [3]
3rdMIX [1] [2] [3]
EXIT

SET PLAY CONDITION OF NON STOP MODE.
SELECT ORDER NUMBER TO BE REGISTERED.

MUSIC GAME DEVICE WITH AUTOMATIC SETTING, METHOD FOR CONTROLLING THE SAME, AND STORAGE MEDIUM THEREFOR

BACKGROUND OF THE INVENTION

1. Field of the Invention

This invention relates to a game system in which a user enjoys playing the game with music.

2. Description of Related Art

There is known a game system designed such that a user enjoys playing the game in conformity with music. Such a game system is disclosed in Japanese laid-open patent application No. 11-151380, for example. In a game system of such kind, instructions of successive operation or manipulation of an input device, which is in conformity with background music, is shown to the user as playing instruction. If the user manipulates the input device in accordance with the instruction, the sound effect corresponding to the manipulation is outputted in addition to background music, and the play by the user is evaluated based on the degree of coincidence between the manipulation instruction shown to the user and the actual manipulation performed by the user.

In the music game described above, the user needs to select a tune or tunes before starting the game. In some game systems, it is also necessary for the user to set difficulty level of play and/or various options and modes, in addition to the selection of tunes. In a conventional game system, the user needs to select tunes and set various setting as described above (hereinafter referred to as "play condition setting") tune by tune for every tunes to play. Namely, the user sets play condition for a tune, then plays that tune, and sets play condition for another tune, and then plays that tune. However, it is troublesome and time-consuming to set play condition tune by tune. Particularly, in the music game of the above mentioned kind, a user feels uncomfortable or irritating if he or she has to set play condition of next tune after playing one tune because such a setting operation necessarily interrupts the user's enjoyable play. Generally, users desire to play tunes successively with lively feeling, without interruption.

SUMMARY OF THE INVENTION

It is an object of the present invention to provide a game system with which a user can set play condition for several tunes at a time and successively play several tunes without interruption between tunes.

According to one aspect of the present invention, there is provided a music game device in which a player manipulates a manipulation unit in conformity with music, the device including: an input unit for setting play information including a plurality of tunes to be successively played and a play order of the plurality of tunes; a storage unit for collectively storing the play information; and a reproduction unit for successively reproducing the plurality of tunes in the play order based on the play information stored in the storage unit.

According to the same aspect, there is provided a method of controlling music game device including the steps of: receiving play information including a plurality of tunes to be successively played and a play order of the plurality of tunes; temporarily and collectively storing the play information; and successively reproducing the plurality of tunes in the play order based on the play information.

According to the same aspect, there is provided a computer-readable storage medium which stores program for controlling a computer to execute music game, the program controls the computer as a computer game device including: an input unit for setting play information including a plurality of tunes to be successively played and a play order of the plurality of tunes; a storage unit for collectively storing the play information; and a reproduction unit for successively reproducing the plurality of tunes in the play order based on the play information stored in the storage unit.

In accordance with the music game device thus configured, the player sets his or her favorite tunes that he or she wants to play. At that time, the player uses the input unit to set the plurality of tunes to be played and the play order of those tunes as the play information. The storage unit collectively stores the play information. The reproduction unit successively reproduces the plurality of tunes in the play order. Therefore, the player can play the plurality of tunes without interruption.

The play information may include information of a number of players and play-difficulty of the plurality of tunes. By this, the play condition can be precisely set to meet player's favor.

The music game device may further include an automatic setting changing unit for automatically changing a part of the play information set by the player to a preset standard play information if the play information set by the player includes a setting which cannot be executed by the game device. Thus, the player can freely set the play information within the allowable range set by the game device provider, and game can be executed to meet the player's favor.

The storage unit may include a removable storage medium from and to which the play information is readable and writable by a different game device. Thus, the play information set by a game device may be used in another game device.

The storage unit may include a link storage unit for exchanging the play information between a plurality of different game devices, and the reproduction unit may perform reproduction based on the play information written into the link storage unit by a different game device. By this, the play information set in a game device can be transferred to and played by another game device.

The music game device may further include: a first display unit for displaying manipulation instruction instructing timings at which the player manipulates the manipulation unit in conformity of the music; and a second display unit for displaying various kinds of dance pictures. By this, the player can enjoy the dance game with manipulating the manipulating unit.

According to another aspect of the present invention, there is provided a game device in which a player manipulates a manipulation unit, the device including: an input unit for setting play information including a plurality of stages which are executed according to a progress degree of game and play conditions in the stages; a storage unit for collectively storing the play information set by the input unit; and a control unit for successively executing the plurality of stages according to the play condition based on the play information stored in the storage unit.

In accordance with the game device thus configured, the player sets the game which he or she wants to play. At that time, the player uses the input unit to set the play information including the plurality of stages to be executed in the game and the play condition in those stages. The storage unit stores the play information, and the control unit executes the stages according to the play condition. Thus, the player can play the plurality of stages without interruption.

The game device may further include an automatic setting changing unit for automatically changing a part of the play information set by the player to a preset standard play information if the play information set by the player includes a setting which cannot be executed by the game device. Thus, the player can freely set the play information within the allowable range set by the game device provider, and game can be executed to meet the player's favor.

The storage unit may include a link storage unit for exchanging the play information between a plurality of different game devices, and the control unit may control progress of the game based on the play information written into the link storage unit by the different game device. By this, the play information set in a game device can be transferred to and played by another game device.

The game device may further include: a standard play information storage unit for storing preset standard play information; and a rewriting unit for rewriting the standard play information in accordance with the play information set by the input unit. By this, the standard data is automatically used if the player does not set the play information, and it is unnecessary for the player to set all play information.

The storage unit may store a plurality of play information. Therefore, the player can maintain his or her favorite play information.

The nature, utility, and further features of this invention will be more clearly apparent from the following detailed description with respect to preferred embodiment of the invention when read in conjunction with the accompanying drawings briefly described below.

BRIEF DESCRIPTION OF THE DRAWINGS

FIGS. 10A and 10B are examples of game picture displayed during play condition setting process.

DETAILED DESCRIPTION OF THE PREFERRED EMBODIMENTS

The preferred embodiments of the present invention will now be described below with reference to the attached drawings.

Figure 1:
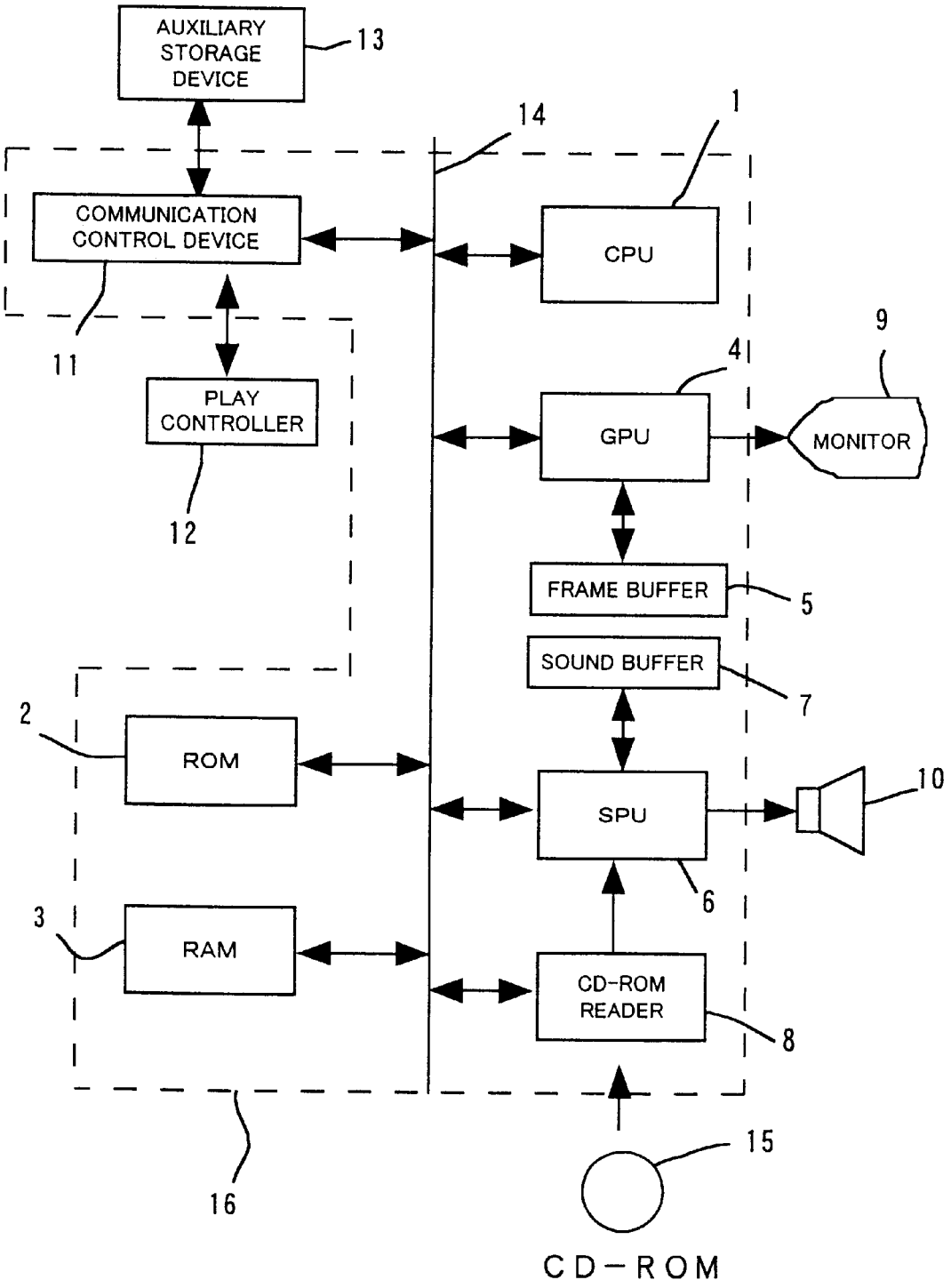
FIG. 1 is a block diagram showing functional blocks of a home game system according to the present invention.

FIG. 1 is a block diagram of a home game system according to the present invention. The home game system executes predetermined game programs stored in a CD-ROM 15 functioning as a memory medium. The game system mainly configured by a game device 16, which includes a CPU 1 mainly configured by a microprocessor, a ROM 2 and a RAM 3 serving as main memory devices for the CPU1, a graphics processing unit (GPU) 104 and a sound processing unit (SPU) 6 for executing processing needed to output visual images and sound, buffers 5 and 7 for the above units 4 and 6 , and a CD-ROM reader 8. The ROM 2 stores operating system which functions as necessary program for the overall control of the game device 16. Game programs and data read out from the CD-ROM 15 is written into the RAM 3 as necessary. The GPU 4 receives picture data from the CPU 1 and writes it into the frame buffer 5, converts the picture data to a video signal and outputs it to the monitor 9 at appropriate timings. The SPU 6 reproduces voice and music data as well as music-source data, which are read out from the CD-ROM 15 and stored in the sound buffer 7, so that corresponding sound is outputted by the speaker 10. The CD-ROM reader 8 reads out necessary programs and data from the CD-ROM 15 according to the instruction by the CPU 1, and outputs signals corresponding to the programs and data thus read out. The CD-ROM 15 stores programs and data necessary for the execution of the game. Generally, a television receiver for home use is used as the monitor 9, and a loudspeaker provided in the television receiver is used as the loudspeaker 10.

Moreover, a communications control device 11 is connected via a bus 14 to the CPU 1, and a play controller 12 and the auxiliary storage device 13 are detachably connected to the CPU 1 via the communication control device 11. The play controller 12 functions as an input device manipulated by a user who plays the game. The play controller 12 includes operation members which are to be manipulated by the user. The communications control device 11 scans the state of the operation members of the play controller 12 at a fixed cycle (e.g. 1/60 second), and outputs signals in correspondence with the scanning result to the CPU 1. Based on that signal, the CPU 1 judges the state of the play controller 12. A plurality of controllers 12 and auxiliary storage units 13 may be connected to the communication control device 11 in parallel, at the same time. Actually, a memory card may be used as the auxiliary storage device 13, for example. With the above-described configuration, the components other than the monitor 9, the speaker 10, the play controller 12, the CD-ROM 15 and the auxiliary storage unit 13 are all accommodated in a single housing to constitute the home game device 16.

Figure 2A:
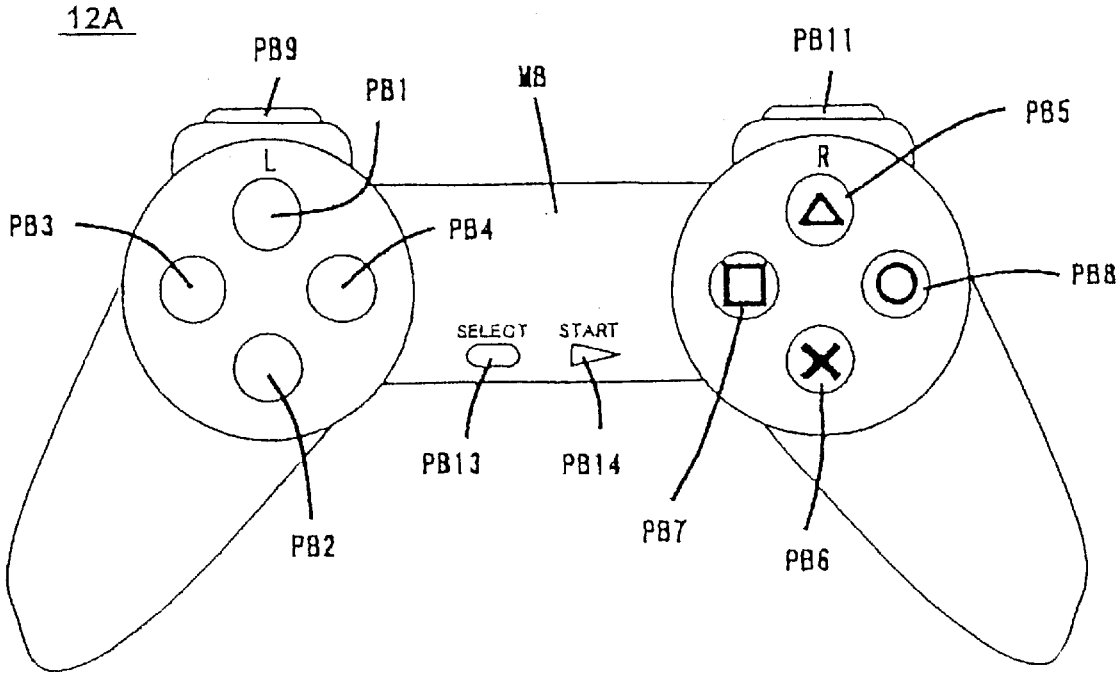
FIGS. 2A and 2B show appearances of an example of game controller usable in the home game system shown in FIG. 1.
Figure 2B:
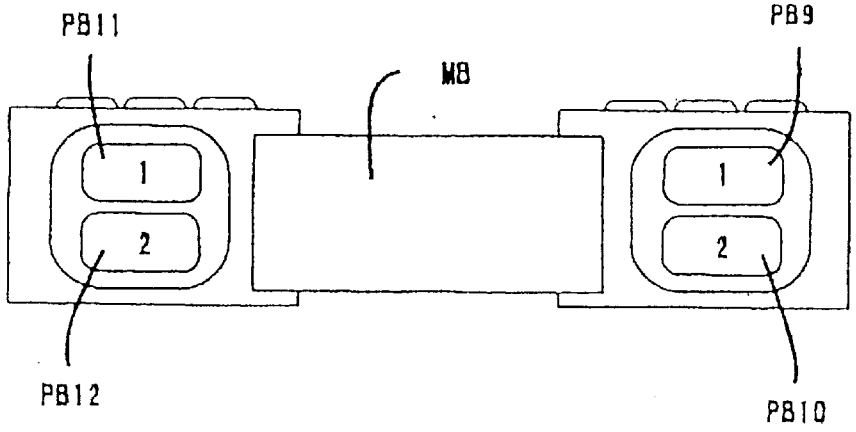

Controllers of various design may be used as the controller 12. For example, a general type controller 12A shown in FIGS. 2A and 2B may be used. This general type controller 12A may be used irrespective of the type of the game that the user plays. FIG. 2A is a plan view of the controller 12A, and FIG. 2B is a front view of the same controller. The controller 12A includes a main body MB which can be held in the hand, push switches PB1 to PB8 on the main face of the main body MB, push switches PB9 to PB12 on the lateral face of the main body MB, and small push switches PB13 and PB14 on the main face of the main body MB. The push switches PB1 to PB4 on the left side are manipulated to designate the movement directions of a game character or cursor upward, downward, leftward, and rightward, respectively. These switches PB1 to PB8 are called as direction designation switches. Various command for playing game are assigned to the switches PB5 to PB8, and appropriate signs are provided on or around the push switches PB5 to PB8 so that they can be visually distinguished. In the example shown here, symbols "Δ", "X", "□", "○" are indicated on the push switches PB5 to PB8 respectively. Numeral "1" is indicated on each of the push switches PB9 and PB11, numeral "2" is indicated on each of the push switches PB10 to PB12, a letter "L" is indicated above the push switch PB1, and a letter "R" is indicated above the push switch PB5. The switch PB9 is called as "L1 button", the switch PB10 is called as "L2 button", the switch PB11 is called as "R1 button", and the switch PB12 is called as "R2 button". The push switch PB13 is called as "select button", and the push switch PB14 is called as "start button".

Figure 3:
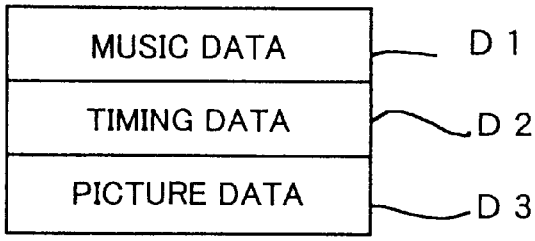
FIG. 3 schematically shows structure of data recorded on a CD-ROM shown in FIG. 1.

As shown in FIG. 3, the CD-ROM 15 stores programs for executing a certain game, a dance game in this embodiment, by the game device 16. The CD-ROM 15 additionally stores music data D1 for reproducing music (tunes) used in the game, timing data D2 which defines reference timings at which the user should push the push switches PB1 to PB12 of the play controller 12 in accordance with the music, and picture data D3 for displaying necessary pictures such as dance scene of game characters on the monitor 9 in accordance with the music reproduced based on the music data D1. The music data D1 are prepared for plural tunes, and the picture data D3 are prepared for plural tunes. These data are managed by codes identifying the tunes. Plural sets of timing data D2, having different play-difficulties and/or different play-modes, are prepared for one music data. The play-mode will be described in more detail later. A set of timing data D2 are divided into plurality of data blocks corresponding to measures (bars) of the tune. Each data block includes information specifying at which beat the push switch should be pressed if the measure for that data block is divided into four or eight beats. The music data D1 is recorded according to the CD-DA or CD-ROMXA format, for example. The CD-ROM reader 8 decodes the music data recorded on the CD-ROM 15 in response to the instruction by the CPU 1 as necessary, and may supply the decoded data to the SPU 6 directly, without routing the bus 14. The SPU 6 D/A-converts the data from the CD-ROM reader 8 and supplies the analog music data to the speaker 10 which outputs music. The correspondence between the playback timing of the music reproduced based on the music data D1 and the manipulation timing of the switches defined by the timing data D2 are determined by using a table which defines the correspondence between the beat numbers of each measure of the music and the sector numbers on the CD-ROM 15, for example.

Figure 4:
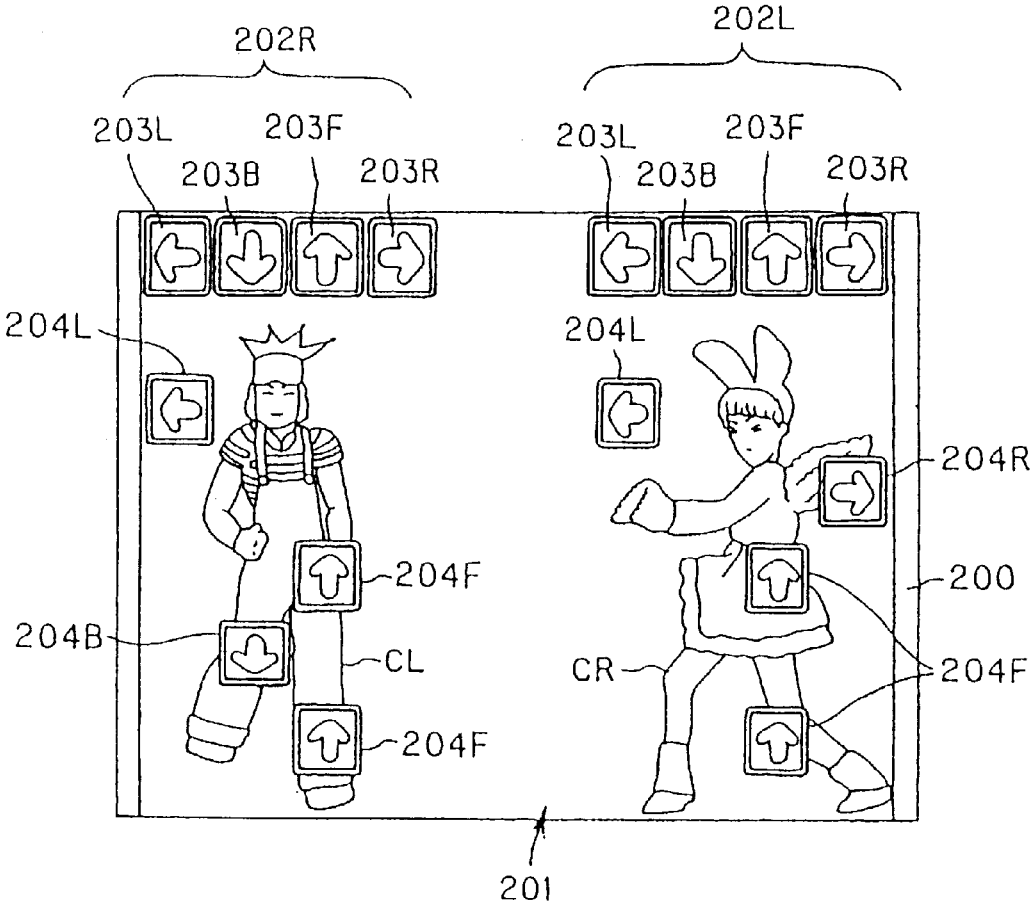
FIG. 4 is an example of game picture shown to a user during dance game executed by the home game system of FIG. 1.

FIG. 4 shows an example of a game picture displayed on the monitor 9 while a dance game is being played according to the program stored in the CD-ROM 15. As shown in FIG. 4, the game picture 200 includes a background picture 201, and gauges 202L and 202R (both may sometimes be represented by the reference code 202) displayed over both sides of the background picture 201. The background picture 201 is created based on the picture data D3 of FIG. 3. For example, moving pictures of characters CL and CR dancing to the music are displayed in the background picture 201. The gauges 202L and 202R are pictures to instruct the players how to operate the game in time with the music. Reference marks 203F, 203B, 203L, and 203R (hereinafter may be represented collectively by reference code 203) contain arrow symbols pointing up, down, left, and right within the game picture 200, and are provided in a horizontal row at the tops of the gauges 202L and 202R. In the game device 16, the reference marks 203F, 203B, 203L and 203R correspond to different operation members of the play controller 12. In the case of general-type controller 12A shown in FIG. 2, the reference mark 203F pointing upward may correspond to the switch PB1, the reference mark 203B pointing downward may correspond to the switch PB2, the reference mark 203L pointing leftward may correspond to the switch PB3, and the reference mark 203R may correspond to the switch PB4.

Timing marks 204F, 204B, 204L, and 204R (hereinafter sometimes represented collectively by reference code 204) are displayed below the reference marks 203F, 203B, 203L, and 203R. The display of the timing marks 204 is controlled in compliance with the timing data D2 of FIG. 3 in the following way. When music playback commences, the CPU 1 sets a part of the timing data D2 (e.g. corresponding to two measures of a tune) as the display range in the gauges 202, and detects the operation timings of the switches PB1, PB2, PB3 and PB4 within that range. Then, the CPU 1 creates picture data for the gauges 202 by replacing the detected timings with the timing marks 204. At this time, display positions of the timing marks 204 are calculated so that the corresponding timing marks 204F, 204B, 204L, and 204R are displayed in proper time sequence below their corresponding reference marks 203F, 203B, 203L, and 203R. The created picture data of the gauges 202 is sent to the GPU 4 together with the background picture 201, created using the picture data D3 of FIG. 3. The GPU 54 creates a game picture 200, by combining the background picture 201 and the pictures of the gauges 202, on the frame buffer 55, and outputs the created game picture 200 at a predetermined timing to be displayed on the monitor 9.

The above process is performed repeatedly in a predetermined cycle. The head of the display range is set so as to correspond with the performance position of the tune at the moment of process, and the display range is shifted by a predetermined amount from the head of the tune toward its end by each time the process is performed. As a consequence, the timing marks 204 gradually move upwards on the gauges 202 as the music playback progresses. Then, when the timing marks 204 coincide with the reference marks 203, the operation timings of the switches PB1 to PB4 set in correspondence with the reference marks 203 arrive. The timing arranged in the proper time sequence below the reference marks 203, thereby enabling the users to easily ascertain future control operations.

Figure 5:
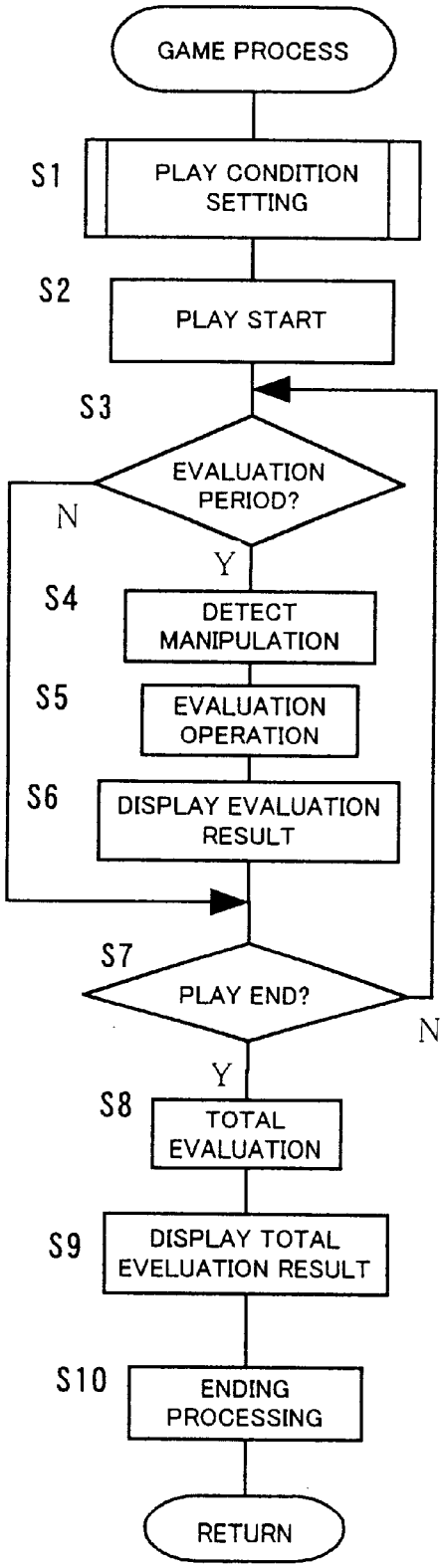
FIG. 5 is a flowchart showing basic process of CPU executing dance game according to the invention.

FIG. 5 is a flowchart showing the game process executed by the home game device 16. When a user sets the game CD-ROM 15 in the game device 16 and turns the power of the game device 16 ON, the CPU 1 reads out data recorded on the CD-ROM 15 and performs necessary initial setting. Then, the CPU 1 waits for the game start instruction inputted by the user, and starts the game process shown in FIG. 5 when receiving the signal corresponding to the play start instruction made onto the controller 12 by the user. In the process shown in FIG. 5, first the play condition is set according to the instruction by the user (step S1). The play condition setting includes selection of the play-mode, play-difficulty and tune to be played. Since the play condition setting relates to the heart of the invention, this will be described later in more detail. After the play condition is set, the CPU 1 instructs the play start to the associated elements of the game device 16 (step S2). By this, the selected music data is supplied from the CD-ROM reader 8 to the SPU 6, and the music data is reproduced. In addition, the display process of the game picture 200, i.e., the background picture 201 and the gauge 202 is started. The display process is repeated until the game ends. In order to synchronize the displayed picture with the music playback, the play start instructions to the associated elements in the game device 16 may be sent with appropriate delay.

After the play start, the CPU 1 determines whether or not the evaluation period arrives, based on the present playback position and the timing data D2 (step S3). In the evaluation period, it is determined whether or not the timing of the user's switch manipulation is appropriately coincident, in time, with the preprogrammed manipulation timing in the timing data D2. The evaluation period is set to have a predetermined time width before and after the manipulation timing defined by the timing data D3. Assuming that the time length of one beat in a tune being played is X, for example, the evaluation range has the time width X/2 before and after the manipulation timing. If the timing data D2 defines that the third beat of Nth measure in the tune being played is the manipulation timing of the switch PB5, the evaluation period for the manipulation timing of the switch PB5 has the time width of ½ beats before and after the third beat.

If it is determined in step S3 that the evaluation period arrives, the manipulation of the switches PB within the evaluation period is detected (step S4). Then, the evaluation operation is executed to evaluate the detected manipulation (step S5). If the switch identical to the switch, for which it is determined in step S3 that the evaluation period arrived, is manipulated by the user, the manipulation is evaluated more excellent as the time shift of the timing, at which the switch is actually manipulated by the user, from the manipulation timing defined by the timing data D2 is small. For example, the score may be 100 points if the time shift is zero, the score may be zero if the time shift is more than half of the time width of the evaluation period of the actual manipulation by the user and the preprogrammed manipulation timing. Thus, the score is calculated dependently upon the time shift. If the switch manipulation is not detected or if the manipulation of an incorrect switch is detected during the evaluation period, the evaluation result is lowest. If the evaluation period for plural switches PB overlap with each other in time, the evaluation is separately performed in timely parallel. The evaluation result is stored in the RAM 3. In the evaluation operation, the total score from the playback start of the tune is operated. The total score may be the sum of the scores from the playback start to the current time. If a score smaller than a predetermined standard score happens at a certain evaluation period, that score may be subtracted from the total score until that time.

When the evaluation operation ends, the information corresponding to the operation result is shown to the user (step S6). In that case, the score itself may be displayed on the game picture 200, or alternatively the score from 0 point to 100 points may be classified into predetermined number of ranks and the rank to which the result belongs may be displayed, like "GREAT", "POOR", and the like, for example. It is noted that the evaluation operation and/or display of the evaluation result are not necessarily performed at every manipulation timing, and may be performed at every unit (e.g., one measure). When the evaluation result is displayed, the CPU 1 determines whether or not the play ends (step S7). Normally, when one tune is played to its end or when the total score becomes lower than a predetermined standard level, the play ends. However, in NON-STOP mode described later, the play ends when all of preset plural tunes are played or when the total score becomes lower than a predetermined standard level. If it is determined in step S3 that the evaluation period does not arrive, the process goes to step S7. If it is determined that the play does not end (step S7; No), the process goes back to step S3. If it is determined that the play ends (step S7; Yes), the total evaluation of that play is performed based on the evaluation results stored in the RAM 3 (step S8), and information corresponding to the total evaluation result is shown to the user (step S9). As the total evaluation result, the sum of the scores obtained in step S5 for the respective manipulation may be used, for example. The total evaluation result may be varied in consideration of the number of the evaluation results belonging to highest or lowest rank. After displaying the total evaluation result, a predetermined ending process is executed (step S10), and the game process for one tune ends. If the total score is higher than the predetermined standard level after one tune is played, the tune is cleared and the game progresses to the next tune.

Next, the play condition setting process (step S1 in FIG. 5) which relates to the heart of the invention will be described with reference to FIGS. 6 to 11. It is noted that the selection and the setting operation described below may be performed by the user's manipulation of the push switches PB on the play controller 12. In the play condition setting process, first the user selects the game play mode (step S20). As the game play mode, plural different modes determined basically in view of play-difficulties are prepared, and there are "EASY MODE", "NORMAL MODE" and "HARD MODE" in this example. In those modes, different tunes determined in consideration of the play-difficulty are included. Namely, relatively easy tunes are included in the EASY MODE, and relatively difficult tunes are included in the HARD MODE. The NORMAL MODE includes tunes of intermediate play-difficulty.

In the present invention, in addition to those three modes, there are prepared "NON-STOP REVOLUTION" (hereinafter also referred to as "successive play mode") by which non-stop play is achieved and "NON-STOP ORDER" (hereinafter also referred to as "successive setting mode") by which setting for successive play is achieved. Namely, NON-STOP ORDER is a mode in which the play condition for plural tunes can be set at a time, and NON-STOP REVOLUTION is a mode in which the plural tunes are successively played according the play condition setting made in NON-STOP ORDER. In step S20, the user selects one of those five modes. Then, the CPU 1 determines whether or not the game play mode selected in step S20 is NON-STOP ORDER (step S22), and if Yes, the process enters the NON-STOP ORDER process (step S24) shown in FIG. 7. If the game play mode selected in step S20 is not NON-STOP ORDER, the CPU 1 determines whether it is the NON-STOP REVOLUTION (step S26). If Yes, the process enters the NON-STOP REVOLUTION process (step S28) shown in FIG. 8. If step S26 results in No, the mode selected in step S20 is one of EASY MODE, NORMAL MODE and HARD MODE in which the tune to be played is selected tune by tune. Therefore, the process enters the normal setting mode (step S30) shown in FIG. 9. Thus, the play condition setting ends.

Figure 7:
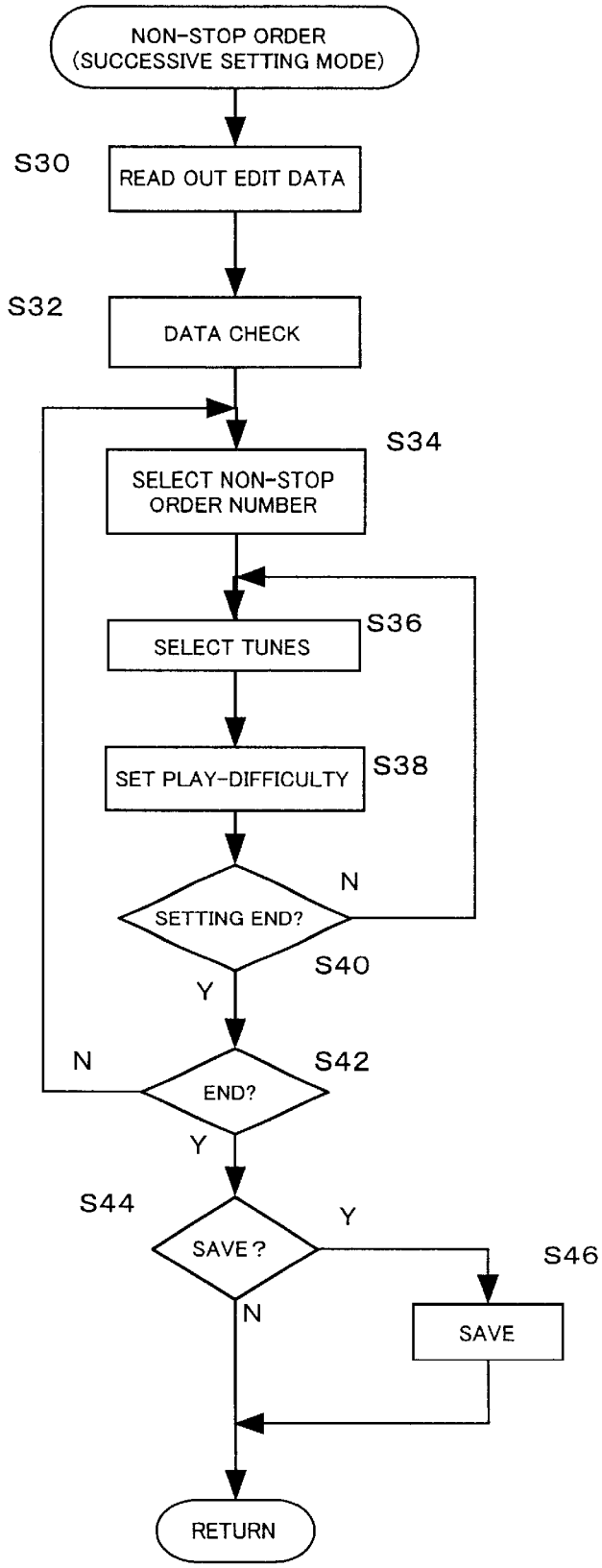
FIG. 7 is a flowchart showing NON-STOP ORDER process (successive setting mode) shown in FIG. 6.

Next, the NON-STOP ORDER process will be described with reference to the flowchart shown in FIG. 7. If the NON-STOP ORDER is selected, first the CPU 1 accesses the memory card (i.e., the auxiliary storage unit 13) to read out edit data therefrom (step S30). An example of the game picture displayed on the monitor 9 is shown in FIG. 10A. At the upper part of FIG. 10A, the words "NON STOP ORDER" is shown, indicating that the NON-STOP ORDER is being selected. By this step S30, edit data is written into the RAM 3 if it exists in the memory card. The edit data is timing data (see. FIG. 3) for tunes to be played, which the user himself has produced in advance. The user can produce the timing data for his or her favorite tunes, in addition to the timing data D2 stored in the CD-ROM 15, and can use it when playing the game. The timing data thus produced by the user himself is referred to as "edit data". When produced, the edit data is stored in the memory card. The user, who wants to play with the edit data, inserts the memory card storing the edit data into the game device 16 and selects the edit data in the tune selecting process described later. Since the method of producing edit data is described in a Japanese laid-open patent application No. 11-103114, which is herein incorporated by reference, filed by the applicant of this application, and hence the detailed description will be omitted. It is noted that the data prepared in advance by the game manufacturer and originally stored in the CD-ROM 15 is hereinafter referred to as "original data" in order to distinguish it from the edit data.

Figure 11A:
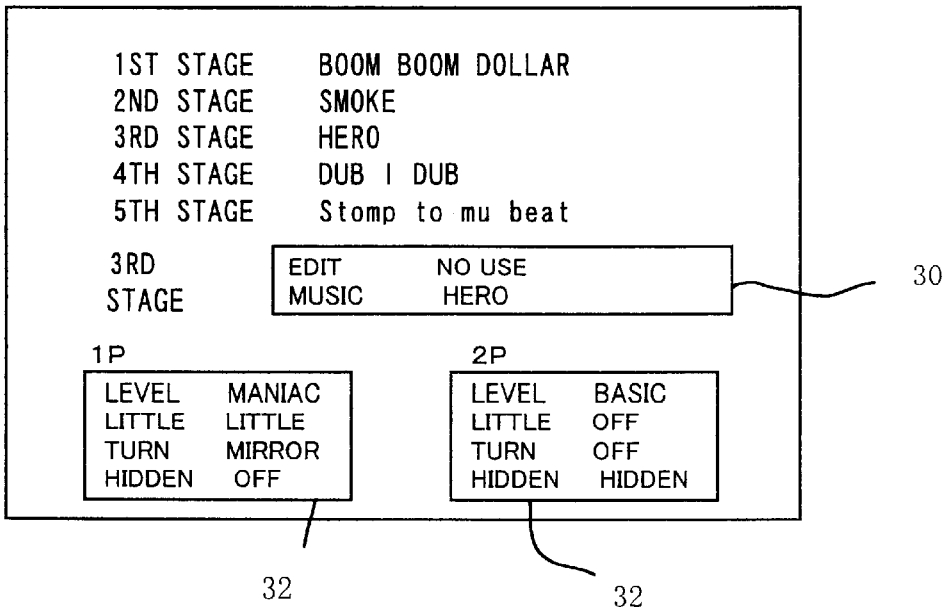
FIGS. 11A and 11B are other examples of game picture displayed during play condition setting process.
Figure 11B:
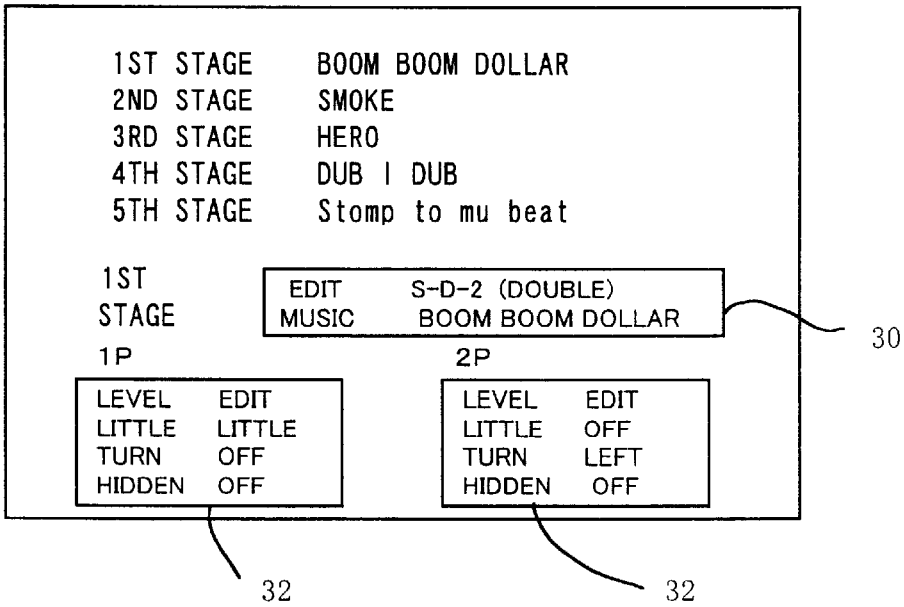

Then, data check is performed (step S32). The data check is process to check whether the edit data read out in step S30 is broken or whether the edit data includes incorrect values, etc. It is noted that the broken or incorrect data may be repaired to some extent by changing it to the initial value or else according to a given program. In the data check, information relating to the player, (e.g., whether the data is for single-player or for two-player) is read out, and is used in the check process at the time of play order setting described later. Then, as shown in FIG. 10B, the order number selection picture is displayed, and the user selects one of the order number of the NON-STOP ORDER (step S34). In the NON-STOP ORDER, a plurality of tunes are set as a group, and a plurality of groups may be prepared. In the example shown in FIG. 10B, the user can register up to three groups, and the identification information of those groups is called as "order number". When the user selects one order number, the process goes to the setting of the tunes to play, the play-difficulty, etc. FIGS. 11A and 11B show the examples of the setting picture.

First, the user selects tunes (step S36). In this example, one group of NON-STOP ORDER includes arbitrary number of tunes up to 5 tunes. In this example, as shown in FIG. 11A, one tune is associated with the concept of one stage, and shown in the game picture as "stage". The user first selects the name of the first tune. Normally, the user selects one favorite tune from original data. In the description of step S20, it is described that EASY MODE, NORMAL MODE and HARD MODE include different tunes based on their play-difficulty. In this NON-STOP ORDER, the user can select the favorite tunes from any tunes included in those three modes. If the edit data is used, the user can select one of the edit data in the item "ED1T" in the selection box 30 in FIG. 11A. In the example of FIG. 11A, the edit data is not being used, and hence the item ED1T is set to "NO USE". However, in the example of FIG. 11B, the edit data is being selected, and the identification number of the selected edit data (i.e., "S-D-2") is being displayed.

Then, the user sets the play-difficulty (step S38). Specifically, the user sets each items shown in the play-difficulty setting box 32 shown in lower portion of FIGS. 11A and 11B. The items shown in the box 32 will be described. The item "LEVEL" indicates the play-difficulty. "MANIAC" is the most difficult level, and "BASIC" is the easiest level. "ANOTHER" is an intermediate level between "MANIAC" and"BASIC". The item "LITTLE" is an optional mode in which data amount of the play manipulation is somewhat reduced to make the tune little bit easier to play. "LITTLE" is the mode in which data amount is reduced, and "OFF" is the mode in which data amount is not reduced. The item "TURN" is an optional mode in which the manipulation timing of the push switches PB described with reference to FIG. 4 is rotated. If the item "TURN" is set to "LEFT", the manipulation timing of the push switches is rotated by 90 degrees in the left (i.e., counterclockwise) direction, and the display of the timing mark 204 shown in FIG. 4 is changed. For example, if the item "TURN" is set to "LEFT", at the timing at which leftward timing mark 204L should be shown, the downward timing mark 204B, obtained by rotating the timing mark 204L leftward by 90 degrees, is shown. Similarly, if the item "TURN" is set to "RIGHT", the manipulation timing is rotated by 90 degrees in the clockwise direction. Therefore, the upward timing mark 204F is shown in place of the leftward timing mark 204L. If the item "TURN" is set to "MIRROR", the manipulation timing and the timing marks 204 on the game display is rotated by 180 degrees. Therefore, the timing mark 204R is shown at the timing the timing mark 204L should be shown. The item "HIDDEN" is an optional mode in which some of the timing marks 204 are omitted are not shown to the user. In the "HIDDEN" mode, some timing marks 204 are not shown so that the play-difficulty is substantially increased. If the item "HIDDEN" is set to "OFF", all timing marks 204 are shown in a normal manner.

FIG. 11A is an example of the game picture in which the user is setting the third tune and its play-difficulty. The tune number (stage number) of the third tune being selected is shown at the left of the tune selection box 30, showing that the setting for the third tune is being performed. The play-difficulty setting box 32 is set and shown for each player.

FIG. 11B is another example of the game picture during the play condition setting. In this example, the play condition for the first tune is being set, and the edit data is used for the first tune as shown by the tune selection box 30. Namely, the tune "BOOM BOOM DOLLAR" is selected as shown by the item "MUSIC", and the identification number of the edit data "S-D-2" is shown at the item "ED1T". The "(DOUBLE)" indicates that the edit data S-D-2 is produced for the play by two players. In the play-difficulty setting box 32, the item "LEVEL" is automatically set to "ED1T". Since the edit data is produced by the user, no other level is prepared unlike the original data prepared by the game software side, and no special play can be performed other than simply reproducing the edit data.

When the play-difficulty is set for the first tune in this way, it is determined whether or not the setting for the order number is ended (step S40). If the setting for the second and further tune is needed, the process goes back to step S36 and the user sets the play condition for the next tune in the same manner. The user can set desired number of tunes within 5 tunes, and if the play condition for all those desired tunes is finished, the user inputs the instruction to finish the setting (step S40; Yes). When the user finishes the play condition setting corresponding to that order number, then it is determined whether or not the setting in the NON-STOP ORDER is ended (step S42). If the user wants to set the play condition for other order number, he or she instructs so, and the process goes back to step S34. Therefore, the user can set the tunes for other order numbers. On the other hand, if the NON-STOP ORDER is to be ended, the user instructs so (step S42;Yes). In this embodiment, the setting can be made up to 5 tunes, however, it is unnecessary to set all 5 tunes. At the time of tune selection in step S36, once standard data is set for all five tunes and then the standard data is rewritten in steps S36 and S38. Therefore, if all five tunes are played without setting for all five tunes, the tunes not set are played according to the standard data.

When the ending of the NON-STOP ORDER is instructed, it is inquired to the user whether or not the order data set during the NON-STOP ORDER is to be saved (step S44). If the user does not instruct saving the data, the process goes back to the routine shown in FIG. 6. On the other hand, if the user instructs to save the data, the data is stored in the memory card (step S46). Since the order data being produced is written on the RAM 3 during the execution of the NON-STOP ORDER, the CPU 1 saves the order data on the RAM 3 to the memory card in response to the save instruction. The order data is configured as a part of system data. If the order data once produced is changed by the NON-STOP ORDER thereafter, the system data portion on the RAM 3 is also changed. Therefore, if the system data is saved after that, the order data after the change is saved to the memory card. The program for executing the NON-STOP ORDER may be designed to automatically save the order data, and in such a case the order data is automatically saved from the RAM 3 to the memory card when the NON-STOP ORDER ends.

Figure 8:
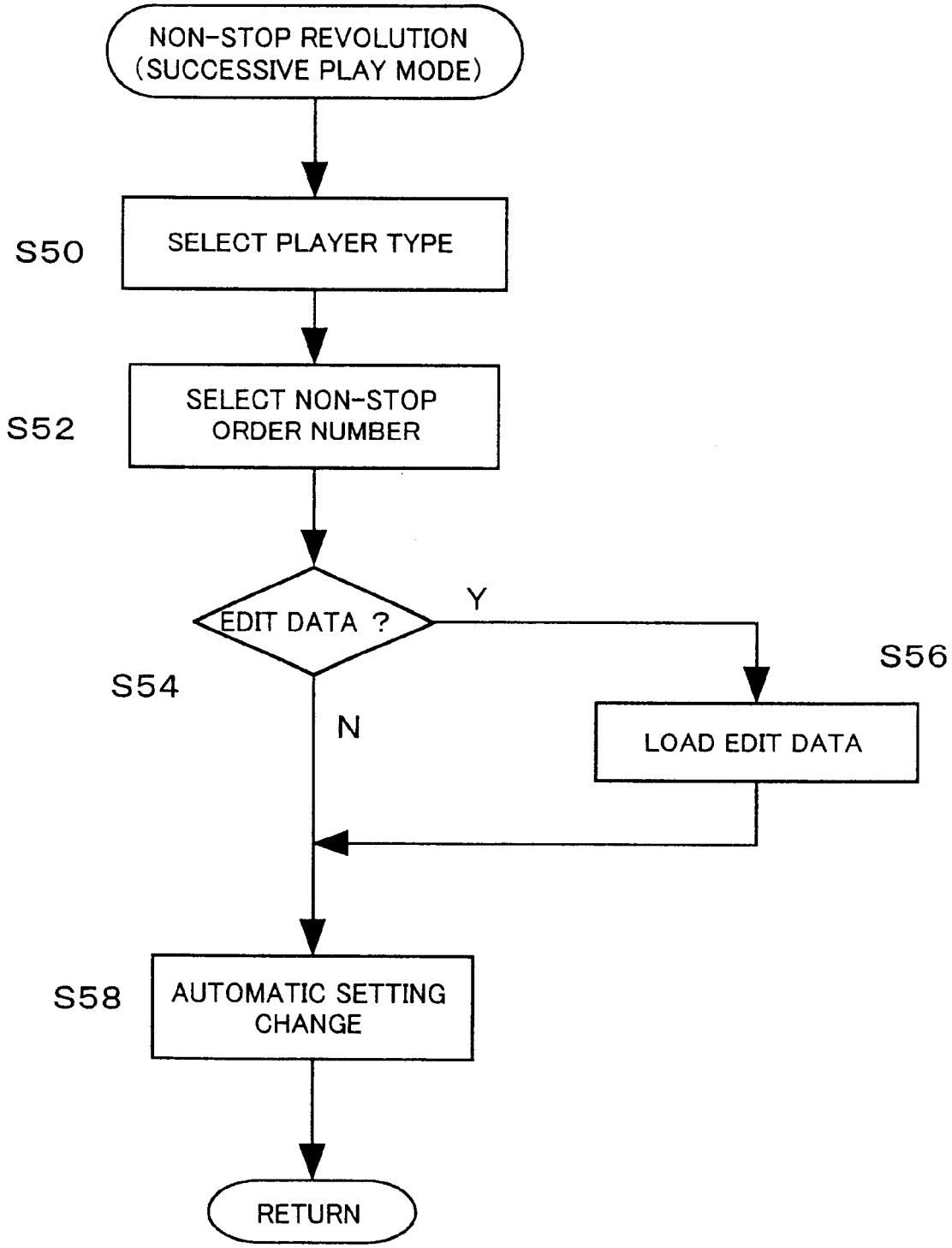
FIG. 8 is a flowchart showing NON-STOP REVOLUTION process (successive playing mode) shown in FIG. 6.

Next, the description will be given of the NON-STOP REVOLUTION (successive play mode), in which the tunes are successively played according to the order set during the NON-STOP ORDER, with reference to the flowchart of FIG. 8. First, the user selects player type (step S50). The player type is the kind of users who play the game, and includes four modes, i.e., single-mode, couple-mode, versus-mode and double-mode. The single-mode is played by one user, and the couple-mode is played by two users in cooperation. The versus-mode is played by two users who compete with each other with their scores, and the double-mode is played by a single user who uses the area for two players. Then, the user selects one of the number of NON-STOP ORDER set in advance (step S52). Then, it is determined whether or not the order data corresponding to the selected number is set to use edit data (step S54). If the user of edit data is set, the CPU 1 refers to the order data to load the designated edit data from the memory card (step S56). It is noted that, if the NON-STOP REVOLUTION is executed just after the order is set during the NON-STOP ORDER, the order data set during the NON-STOP ORDER still remains on the RAM 3 and hence it is unnecessary to read out the order data from the memory card. Therefore, the order data should be read out from the memory card in the cases where the game device is turned ON after being reset but the system data has not been loaded yet, or where the system data has been loaded but the order data stored in another memory card is to be used. Then, the CPU 1 performs automatic setting change by executing the program prepared in advance (step S58). The automatic setting change is to change the order data set by the user during the NON-STOP ORDER to the standard play setting data prepared in the original game program if the order data set by the user includes inconsistency or incorrect combination in the selected or set tunes or play-difficulties so that it cannot be executed. The condition to change the order data to the standard data is determined by the game side in advance. For example, if the player mode is set to double, it is inhibited to set the item LEVEL to MANIAC. This is because no MANIAC level data is prepared for the player mode double, and in this case the item LEVEL is automatically changed to ANOTHER. In another example, if the player mode is set to double, it is inhibited to set the item TURN to LEFT or RIGHT. This is because the LEFT and RIGHT mode in which the timing marks are rotated by 90 degrees becomes too difficult to play. Therefore, if the player mode is set to double, the item TURN is automatically set to OFF. The above described automatic setting change is also performed when edit data is selected. For example, if the edit data is selected but corresponding edit data is not stored in the memory card, the original data corresponding to the tune is used. When edit data is stored in the memory card but the edit data corresponding to the selected tune is not included, the original data is used. When the player type is set to double but the selected edit data corresponds to the player type SINGLE or COUPLE, or the player type is not DOUBLE but the selected edit data corresponds to the player type DOUBLE, the original data is automatically used. If reading out edit data from the memory card is unsuccessful, no edit data is available and hence original data is used. By the automatic setting change, a freedom is given to the play condition setting by the user, and inconsistent or incorrect setting which is impossible to perform may be removed, thereby executing the play under the control of the game system. After the automatic setting change, the process returns to the main routine shown in FIG. 5 to continue the play in accordance with the setting.

Figure 6:
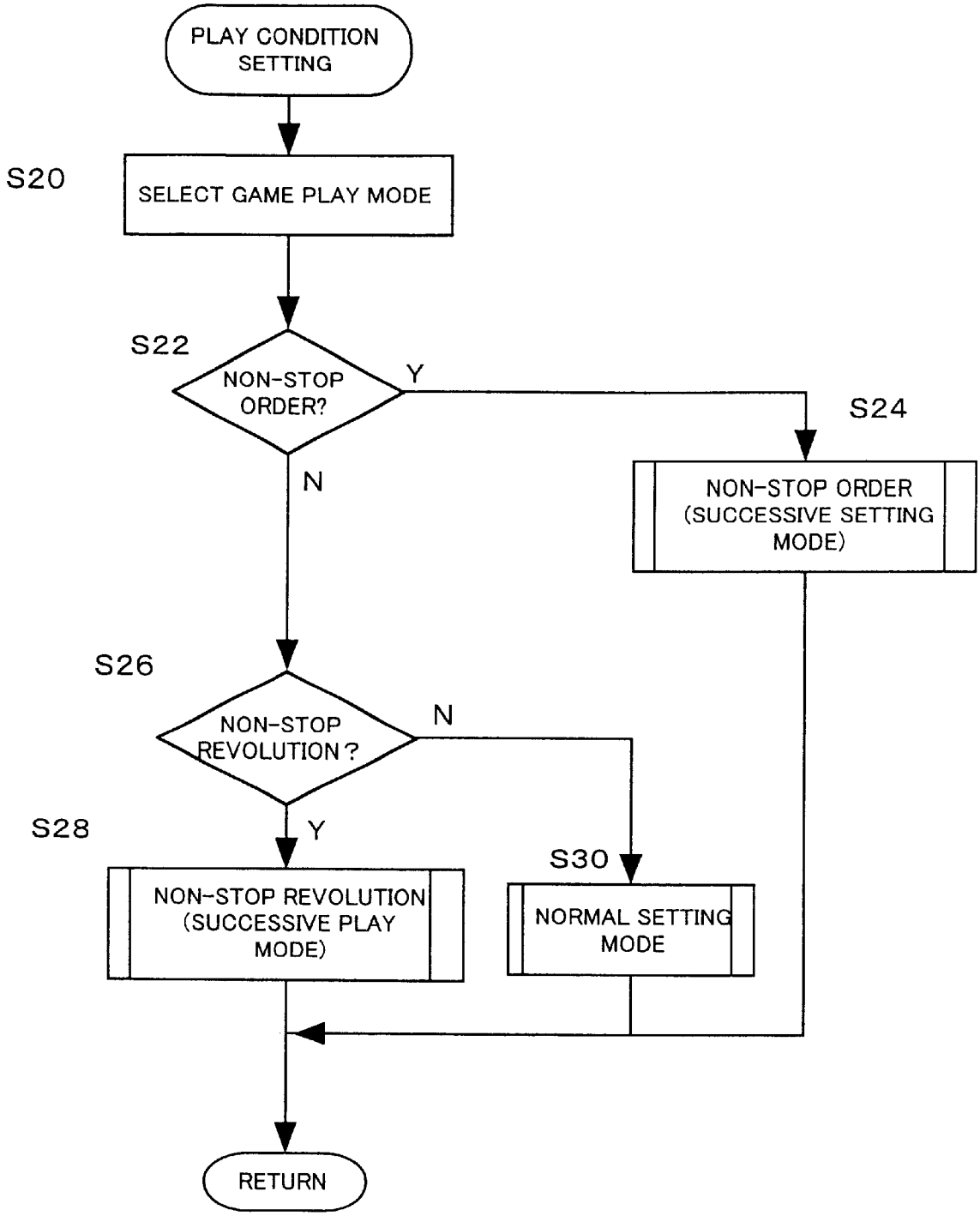
FIG. 6 is a flowchart showing play condition setting process shown in FIG. 5.
Figure 9:
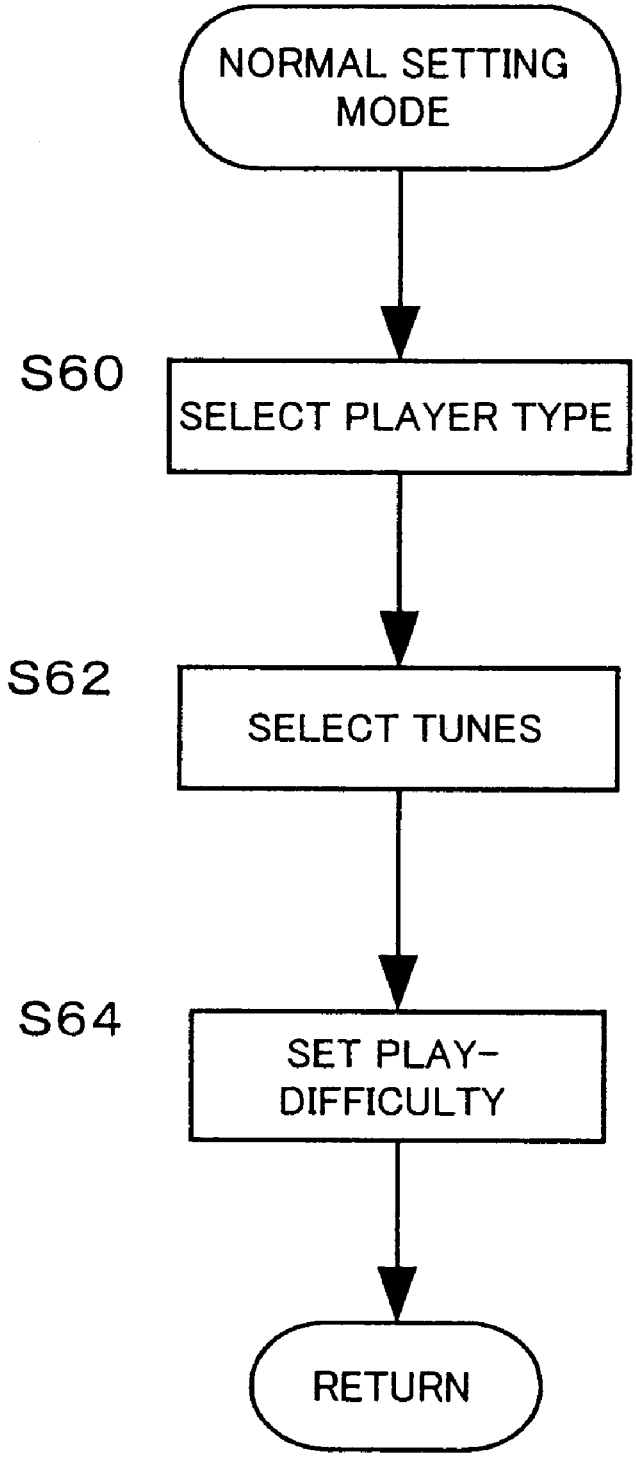
FIG. 9 is a flowchart showing normal setting mode shown in FIG. 6.

Next, the normal setting mode in step S30 of FIG. 6 will be described with reference to FIG. 9. If one of the game play mode EASY, NORMAL and HARD is selected in step S20 in FIG. 6, the user sets the play condition for every tune in a normal manner and then plays the tunes. Therefore, the user selects the player type in step S60, selects tune in step S62 and sets the play-difficulty in step S64. Since steps S60, S62, S64 are the same as steps S50, S36, S38, respectively, and hence the description will be omitted. When the play condition is set for one tune, the process returns to the main routine shown in FIG. 5, and the play is started.

In the above described examples, it is determined to set common player type in the NON-STOP ORDER (since FIG. 7 does not include player type setting step), the program may be designed such that plural player type may be set in an intermixed manner even in the NON-STOP ORDER. In that case, the first tune may be set to the SINGLE mode for one player and the second tune may be set to COUPLE mode for two players. Instead of permitting the setting of plural player type in the NON-STOP ORDER, the NON-STOP REVOLUTION may be executed with using the edit data produced to include different player modes. For example, the edit data produced for the SINGLE mode by a single player is used for the first tune, and the edit data produced for DOUBLE mode by two players is used for the second tune. Further, when producing edit data for COUPLE, VERSUS or DOUBLE mode, the edit data corresponding to the second player may be left blank (with no data) to substantially make the edit data for SINGLE mode.

While the application of the invention to home game system is described, the invention is also applicable to business-use game apparatus. In that case, the program for setting the play condition in the business-use game apparatus may be changed to the program including the NON-STOP ORDER and the NON-STOP REVOLUTION as described above. Further, by utilizing the linkage function of the home game system and business-use game system via memory card, the order data set in the NON-STOP ORDER by one of them may be used the other. Further, by restricting the linkage between them, the NON-STOP REVOLUTION in the home game system may be permitted only if a predetermined play level is achieved in the business-use game system. In that case, when the predetermined play level is achieved in the business-use game system, information indicating that achievement is written into the memory card, and the home game system is controlled to enable the NON-STOP REVOLUTION only if the information is detected.

As described above, according to the invention, the player can set the plural stages (tunes) to be successively played, the performance of the game is improved. In the NON-STOP ORDER, since arbitrary tunes may be selected from all tunes classified into the EASY-mode, NORMAL-mode and HARD-mode, the combination of tunes only possible by the NON-STOP ORDER is achieved, thereby enhancing the nature of amusement and topic.

In a conventional music game, the player cannot select the favorite tune from all tunes prepared. Namely, only limited tunes within the predetermined range are offered to the player according to the progress of the game, and the player can select the tune only from those limited tunes. This limits the possible selection range by the player. On the contrary, according to the present invention, the player can arbitrarily select tunes and play modes, and hence unique combination of tunes and play modes may be achieved.

While the above embodiment is directed to the music game, especially dance game, the present invention is applicable to game of other various types, including plural stages. For example, in the case of battle game, the character and stage may be selected in advance, and the battle play may be successively performed at the pre-selected plural stages by the pre-selected characters.

As described above, according to the present invention, plural tunes may be selected and set at a time so that they can be successively played. Therefore, the play is not interrupted between the tunes, and the game can be played comfortably. By this, the time required to set the selection of tunes or the like may be reduced, and the rotation frequency of the customer may be improved. This increases the playable number of tunes in a unit time, thereby making the game more attractive to users.

The invention may be embodied on other specific forms without departing from the spirit or essential characteristics thereof. The present embodiments therefore to be considered in all respects as illustrative and not restrictive, the scope of the invention being indicated by the appended claims rather than by the foregoing description and all changes which come within the meaning an range of equivalency of the claims are therefore intended to embraced therein.

The entire disclosure of Japanese Patent Application No. 11-239021 filed on Aug. 25, 1999 including the specification, claims, drawings and summary is incorporated herein by reference in its entirety.

What is claimed is:

1. A music game device in which a player manipulates a manipulation unit in conformity with music, the music game device comprising:

an input unit for setting play information including a plurality of tunes to be successively played and a play order of the plurality of tunes;

a storage unit for collectively storing the play information;

an automatic setting changing unit for automatically changing a part of the play information set by the player to a preset standard play information if the play information set by the player includes a setting which cannot be executed by the music game device; and a reproduction unit for successively reproducing the plurality of tunes in the play order based on the play information stored in the storage unit.

2. The music game device according to claim 1, wherein the play information includes information of a number of players and play-difficulty of the plurality of tunes.

3. The music game device according to claim 1, wherein the play information includes at least one play condition according to which the player plays the game.

4. The music game device according to claim 1, wherein the storage unit comprises a removable storage medium from and to which the play information is readable and writable by a different game device.

5. The music game device according to claim 1, wherein the storage unit comprises a link storage unit for exchanging the play information between a plurality of different game devices, and wherein the reproduction unit performs reproduction based on the play information written into the link storage unit by a different game device.

6. The music game device according to claim 1, further comprising:

a first display unit for displaying manipulation instruction instructing timings at which the player manipulates the manipulation unit in conformity of the music; and a second display unit for displaying various kinds of dance pictures.

7. The music game device according to claim 1, further comprising:

a standard play information storage unit for storing preset standard play information; and a rewriting unit for rewriting the standard play information in accordance with the play information set by the input unit.

8. The music game device according to claim 1, wherein the storage unit can store a plurality of play information.

9. A game device in which a player manipulates a manipulation unit, the game device comprising:

an input unit for setting play information including a plurality of stages which are executed according to a progress degree of game and play conditions in the stages;

a storage unit for collectively storing the play information set by the input unit;

an automatic setting changing unit for automatically changing a part of the play information set by the player to a preset standard play information if the play information set by the player includes a setting which cannot be executed by the music game device; and a control unit for successively executing the plurality of stages according to the play condition based on the play information stored in the storage unit.

10. The music game device according to claim 9, wherein the play information includes at least one play condition according to which the player plays the game.

11. The music game device according to claim 9, wherein the storage unit comprises a link storage unit for exchanging the play information between a plurality of different game devices, and wherein the control unit controls progress of the game based on the play information written into the link storage unit by the different game device.

12. The music game device according to claim 9, further comprising:

a standard play information storage unit for storing preset standard play information; and a rewriting unit for rewriting the standard play information in accordance with the play information set by the input unit.

13. The music game device according to claim 9, wherein the storage unit can store a plurality of play information.

14. A method of controlling a music game device comprising the steps of:

receiving play information including a plurality of tunes to be successively played and a play order of the plurality of tunes;

temporarily and collectively storing the play information;

automatically changing a part of the play information set by the player to a preset standard play information if the play information set by the player includes a setting which cannot be executed by the game device; and successively reproducing the plurality of tunes in the play order based on the play information.

15. The method of controlling a music game according to claim 14, wherein the play information includes at least one play condition according to which the player plays the game.

16. A computer-readable storage medium which stores a program for controlling a computer to execute a music game, the program controls the computer as a computer game device comprising:

an input unit for setting play information including a plurality of tunes to be successively played and a play order of the plurality of tunes;

a storage unit for collectively storing the play information;

an automatic setting changing unit for automatically changing a part of the play information set by the player to a preset standard play information if the play information set by the player includes a setting which cannot be executed by the music game device; and a reproduction unit for successively reproducing the plurality of tunes in the play order based on the play information stored in the storage unit.

17. The computer-readable storage medium according to claim 16, wherein the play information includes at least one play condition according to which the player plays the game.

* * * * *